US005499769A

United States Patent [19]

Namiki et al.

[11] Patent Number: 5,499,769

[45] Date of Patent: Mar. 19, 1996

[54] FUEL INJECTION VALVE INCLUDING AIR PROMOTING ATOMIZATION

[75] Inventors: Masanori Namiki; Kazuyoshi Mori; Hideo Kato, all of Atsugi, Japan

[73] Assignee: Unisia Jecs Corporation, Atsugi, Japan

[21] Appl. No.: 196,216

[22] PCT Filed: Jul. 16, 1993

[86] PCT No.: PCT/JP93/00996

§ 371 Date: Mar. 15, 1994

§ 102(e) Date: Mar. 15, 1994

[87] PCT Pub. No.: WO94/02736

PCT Pub. Date: Feb. 3, 1994

[30] Foreign Application Priority Data

Jul. 16, 1992 [JP] Japan ..... 4-189715
Dec. 2, 1992 [JP] Japan ..... 4-323480

[51] Int. Cl.[6] ..... F02M 69/00; F02M 69/04; F02M 61/18; F02M 51/06

[52] U.S. Cl. ..... 239/409; 239/585.1

[58] Field of Search ..... 239/407–409, 239/533.12, 585.1–585.5

[56] References Cited

U.S. PATENT DOCUMENTS

| | | | |
|---|---|---|---|
| 4,982,716 | 1/1991 | Takeda et al. | 239/533.12 |
| 5,035,358 | 7/1991 | Katsuno et al. | 239/409 |
| 5,174,505 | 12/1992 | Shen | 239/408 |
| 5,218,943 | 6/1993 | Takeda et al. | 239/533.12 |
| 5,224,458 | 7/1993 | Okada et al. | 239/533.12 |
| 5,232,163 | 8/1993 | Grytz | 239/533.12 |
| 5,301,879 | 4/1994 | Takeda et al. | 239/408 |
| 5,323,966 | 6/1994 | Buchholz et al. | 239/408 |
| 5,360,166 | 11/1994 | Nogi et al. | 239/408 |

FOREIGN PATENT DOCUMENTS

| | | |
|---|---|---|
| 59-7772 | 1/1984 | Japan . |
| 62-15490 | 4/1987 | Japan . |
| 64-24161 | 1/1989 | Japan . |
| 1-148059 | 10/1989 | Japan . |
| 2-37262 | 3/1990 | Japan . |
| 2-99758 | 4/1990 | Japan . |
| 3-10066 | 1/1991 | Japan . |
| 3-73668 | 7/1991 | Japan . |
| 3-202673 | 9/1991 | Japan . |
| 4-50472 | 2/1992 | Japan . |
| 4-89861 | 8/1992 | Japan . |
| 4-107483 | 9/1992 | Japan . |

*Primary Examiner*—Karen B. Merritt
*Attorney, Agent, or Firm*—Foley & Lardner

[57] ABSTRACT

A fuel injection valve wherein fuel sprays discharged from a fuel injection hole are impacted with auxiliary air introduced from outside to thereby promote atomization and subsequent vaporization of the fuel sprays, is provided with fuel spray guide passages for each guiding one of the fuel sprays. As a result, the fuel sprays discharged from the fuel injection holes, are impacted by the auxiliary air to thereby promote atomization and subsequent vaporization thereof, and are guided by the inner walls of the fuel spray guide passages, to thereby control the diffusion and spray direction of the fuel sprays. The cross-sectional shape of the fuel sprays is thus controlled to an optimum shape so that adhesion of fuel to the inner wall of the intake port is minimized, thereby improving combustion, and in particular reducing hydrocarbon emissions and improving fuel consumption.

7 Claims, 9 Drawing Sheets

FUEL INJECTION VALVE INCLUDING AIR PROMOTING ATOMIZATION

TECHNICAL FIELD

The present invention relates to fuel injection valves for internal combustion engines. In particular the invention relates to improvements to those fuel injection valves which promote atomization and subsequent vaporization of a fuel spray by impacting auxiliary air onto the fuel spray.

BACKGROUND ART

Fuel injection valves fitted to internal combustion engines having two intake ports per cylinder, are generally constructed so that fuel can be injected into the two intake ports simultaneously. Such a fuel injection valve as disclosed in Japanese Utility Model Unexamined Publication No. 3-10066, has air paths formed on opposite sides of the fuel spray such that air discharged from the air paths (referred to hereunder as auxiliary air) is impacted onto the fuel spray.

This device, as well as promoting atomization and subsequent vaporization of the fuel spray by impacting the auxiliary air onto the fuel spray, also enables flattening of the cross-sectional shape of the fuel spray to suit the layout of the intake port (herein cross-sectional shape refers to the cross-sectional shape in a plane perpendicular to a central axis of the fuel spray). The device thus enables an improvement in combustion such as at low engine temperatures, and in particular a reduction in hydrocarbon emissions and an improvement in fuel consumption.

More specifically, the conventionally constructed fuel injection valve is mounted on an outer wall of a bifurcated intake port in the vicinity of the branch point thereof, so as to spray two fuel sprays from the fuel injection holes towards the respective two intake ports. The ends of each of the intake ports are however curved significantly towards the vertical direction of the cylinder. Consequently, the cross-sectional shape of the fuel spray is necessarily flattened so that the spray angle in a direction aligned with the two intake ports is greater than the spray angle in the direction perpendicular thereto.

To achieve this, auxiliary air is taken from upstream of the throttle valve and discharged from air ports on both sides of the fuel spray. The resultant impact of the auxiliary air promotes atomization and subsequent vaporization of the fuel spray while flattening the cross-sectional shape of the fuel spray shape, and thus also prevents fuel from adhering to the inner wall of the intake port.

The construction of the conventional fuel injection valve however has no provision for controlling the fuel spray after impact with the discharged auxiliary air, so that the flattened cross-sectional shape is highly susceptible to excessive spreading.

That is to say, the construction of the conventional fuel injection valve enables the promotion of atomization and subsequent vaporization of the fuel spray. However since the cross-sectional shape of the fuel spray can spread excessively due to the impact of the auxiliary air with the fuel spray, it becomes difficult to obtain an optimum fuel spray cross-sectional shape for the intake port layout. Consequently, the fuel spray impacts and adheres to the inner wall of the intake port, thus impeding the beneficial atomization and subsequent vaporization of the fuel spray resulting from impact with the auxiliary air.

Although the discharge amount, discharge velocity, and discharge position etc. of the auxiliary air may be optimized to control any excessive spreading of the cross-sectional shape of the fuel spray under conditions of constant fuel injection, the flattened spread cannot be controlled when there is an increase in fuel injection amount corresponding to a change in load. A good cross-sectional shape over the whole operating range is thus difficult to obtain.

In cases where it is not so necessary to flatten the cross-sectional shape of the fuel spray, such as when a good degree of flattening is obtained from the impact of fuel sprays discharging from a plurality of fuel injection holes, then when auxiliary air is impacted against the fuel spray to promote atomization of the fuel spray, the impact flattens the cross-section of the fuel spray more than necessary. There is thus again the problem of controlling the excessive flatness so as to form a desirable cross sectional shape.

Furthermore, in order to improve combustion, there is also the requirement to even further promote atomization and subsequent vaporization of the fuel spray.

Such problems as mentioned above are not confined to internal combustion engines having two intake ports per cylinder, but also exist with internal combustion engines having one (unbifurcated)intake port per cylinder.

In view of the above heretofore encountered problems, it is an object of the present invention to provide a fuel injection valve which can promote atomization and subsequent vaporization of a fuel spray by impacting a discharge of auxiliary air onto the fuel spray, and which can obtain an optimum fuel spray for various intake port layouts by controlling the cross-sectional shape and injection direction of the fuel spray.

DISCLOSURE OF THE INVENTION

The fuel injection valve according to the present invention thus incorporates a fuel injection valve body having a fuel injection hole to diffusingly discharge fuel therefrom towards an intake port of an internal combustion engine, an atomization promotion device for discharging air towards the fuel spray discharged from the fuel injection valve body, and thereby promoting vaporization of the fuel spray, and a guide device having an opening portion surrounding an outer peripheral portion of the fuel spray which has been subjected to atomization promotion, for controlling the cross-sectional shape and injection direction of the fuel spray.

With such a construction, the atomization and subsequent vaporization of the fuel spray is promoted through impact of the discharged air onto the fuel spray. Also, the diffusion and injection direction of the fuel spray is controlled through contact of the outer peripheral portion of the fuel spray with the inner wall of the opening portion of the guide device. An optimum fuel spray cross-sectional shape for the intake port layout can thus be created. Consequently, impact of the fuel spray against the inner wall of the intake port and adhesion thereto can be prevented, so that the atomization and vaporization of the fuel spray can be promoted to produce a good mixture. As a result, combustion is improved, and in particular hydrocarbon emissions reduced with an improvement in economy.

The fuel injection valve body may incorporate a plurality of fuel injection holes facing in directions which intersect each other, the plurality of fuel injection holes being arranged so that fuel jets discharged therefrom impact with each other to flatten the cross-sectional shape of the resultant fuel spray. Furthermore, the atomization promotion device may be constructed so as to discharge air from opposite sides of the fuel spray and thus flatten the cross-sectional shape of the fuel spray. Moreover, the opening portion of the guide device may be formed to a flattened shape so as to flatten the cross-sectional shape of the fuel spray.

Such constructions enable the cross-sectional shape of the fuel spray to be flattened to give the above mentioned effects, and are thus applicable to more complex intake port layouts.

The atomization promotion device may be constructed so as to discharge air in a direction to control the flattening of the flattened fuel spray, to thereby adjust the cross-sectional shape of the fuel spray.

Such a construction promotes fuel spray atomization and subsequent vaporization while controlling the excessively protruding or spreading portion of the cross sectional shape of the fuel spray to thereby adjust the cross-sectional shape of the fuel spray. The controlling effect on the diffusion of the fuel spray due to the guide device together with the improvement of the degree of freedom in application to intake port layouts which have a comparatively small requirement for flatness of the fuel spray cross-sectional area can be obtained.

The atomization promotion device may be constructed with air discharge ports for discharging air provided opposite to and offset from each other with the fuel spray interposed therebetween.

As a result, front on mutual impact of air discharged from the atomization promotion device can be avoided, thus minimizing wasteful reduction in impact energy as a result of impact between the discharging air. The impact energy from the discharged air can thus be effectively transmitted to the fuel spray so that atomization and subsequent vaporization of the fuel spray is even further promoted.

The atomization promotion device is preferably constructed so as to discharge air towards the downstream side in the direction of progress of the fuel spray.

In this way, impact from opposite directions of fuel spray and air discharged from the atomization promotion device can be avoided, thereby preventing excessive diffusion of the fuel spray cross-section, or reduction in the desirable penetrating force of the fuel spray. The atomization and subsequent vaporization of the fuel spray can thus be stably promoted.

Preferably with an internal combustion engine incorporating two intake ports per cylinder, the guide device may be branched into two opening portions, with an atomization promotion device provided in each of the opening portions.

With such a construction, atomization and subsequent vaporization of the fuel spray can be promoted for each of the bifurcated intake ports, and the fuel can be discharged to create an optimum fuel spray cross-sectional shape for the intake port layout.

Preferably the atomization promotion device is provided downstream of the branch point of the two opening portions of the guide device.

In this way, mutual impact of air discharged in the respective opening portions can be avoided. Consequently, good atomization and subsequent vaporization of the fuel spray inside the respective opening portions can be effectively carried out, and control of diffusion of the fuel spray optimized. Moreover, with L1 as a distance from a lower face of the guide device to a central point of the air discharge portion of the atomization promotion device, θF as ½ the angle between the respective central axes of the two opening portions of the guide device, and θP as the angle between the respective central axes of the bifurcated intake ports of the internal combustion engine, then L1 is preferably set to L1' which satisfies the following equation;

$$\theta F=\theta P/2$$

$$L1'=L1\times\tan(\theta P/2+X)\times\tan(90-\theta P/2)$$

where:

X is within the range from 2.5 ~3.5, and L1 is the maximum length without air discharge from the atomization promotion device, at which the inner peripheral wall of the opening portion of the guide device does not interfere with the fuel spray.

As a result, the cross-sectional shape of the fuel spray is always well formed regardless of the discharge velocity of the air discharged from the atomization promotion device. That is to say, even when for example engine intake air is used for introduction of the discharge air and hence the discharge velocity of the injected air cannot be kept constant, a good fuel spray cross-sectional shape can always be obtained.

BEST MODE FOR CARRYING OUT THE INVENTION

As follows is a description of embodiments of the present invention based on the accompanying drawings.

Figure 9:
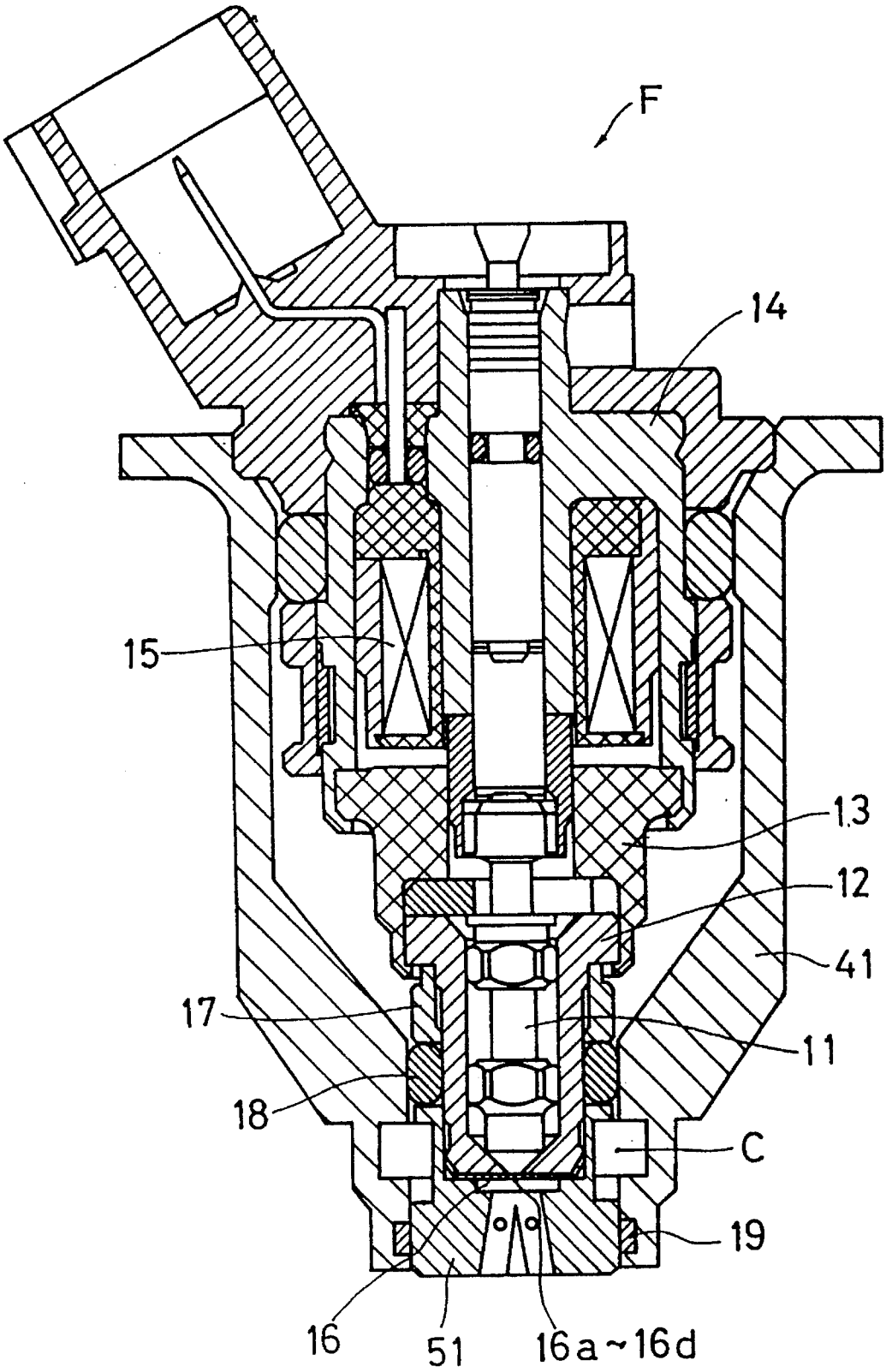
FIG. 9: is a longitudinal cross-sectional view showing the complete fuel injection valve according to the first embodiment.

The overall layout of a fuel injection valve according to a first embodiment is shown in FIG. 9.

In FIG. 9, a fuel injection valve F comprises a nozzle body 12 for fittingly supporting a needle valve 11 (valve body) so as to be freely slidable therein, a first housing 13 connected at one end portion thereof to the nozzle body 12, a second housing 14 connected to an other end portion of the first housing 13, and a solenoid coil 15 retained inside the first and second housings 13, 14, for driving the needle valve 11.

On supplying power to the solenoid coil 15, the needle valve 11 is lifted in the upwards direction in FIG. 9, so that fuel which is supplied from a fuel pump (not shown in the figure ) at a predetermined pressure and stored between the needle valve 11 and the nozzle body 12, is discharged from fuel injection holes 16*a* through 16*d*.

Figure 1A:
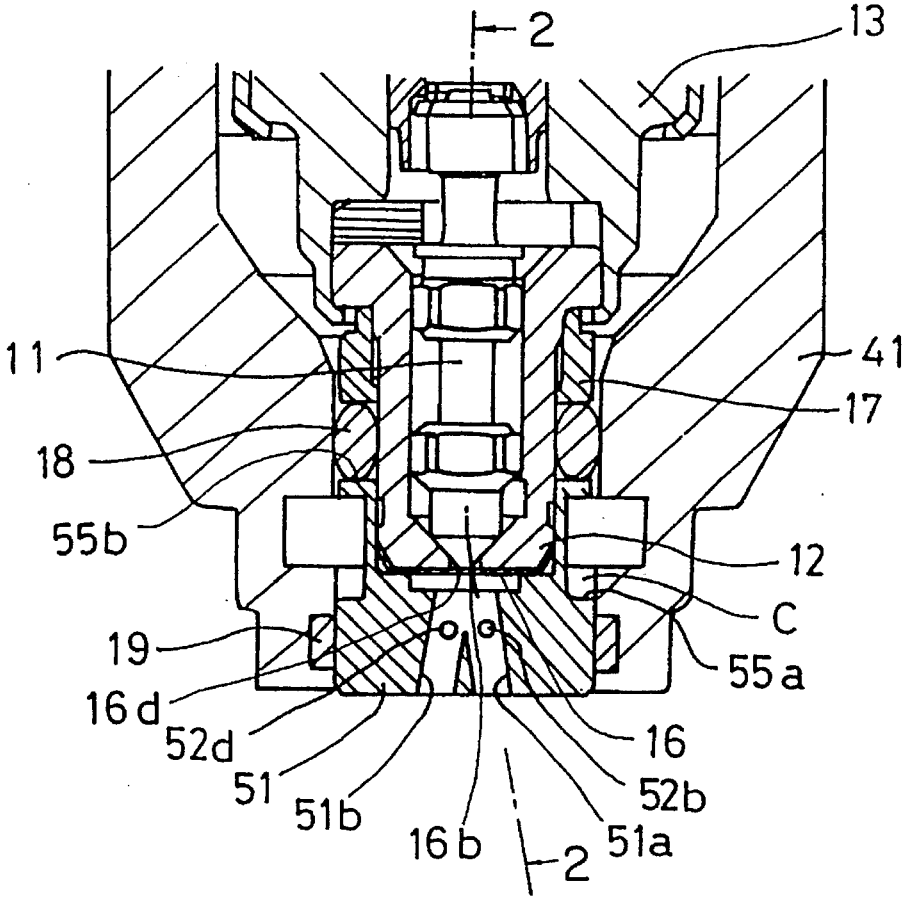
FIG. 1(A): is a longitudinal cross-sectional view of a fuel injection valve according to a first embodiment of the present invention.
Figure 1B:
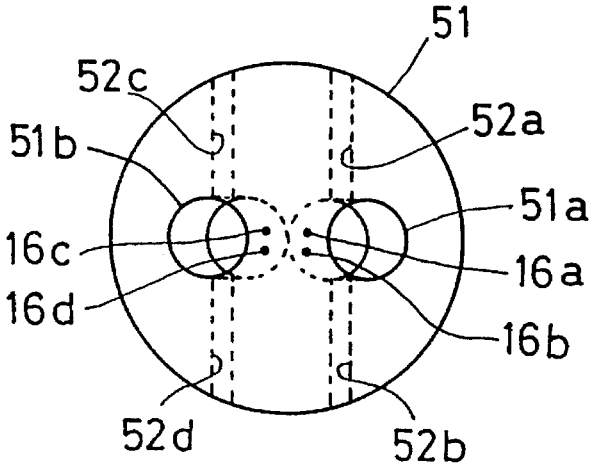
FIG. 1(B): is a bottom view showing a portion of the valve of FIG. 1 (A).

At the tip end portion of the fuel injection valve F, as shown in FIG. 1(A) and 1(B), a cap 51 is supportingly fitted to a tip end portion of the nozzle body 12 with a fuel injection hole plate 16 interposed therebetween. A plurality of fuel injection holes 16*a* through 16*d* are formed in the fuel injection hole plate 16.

Figure 4A:
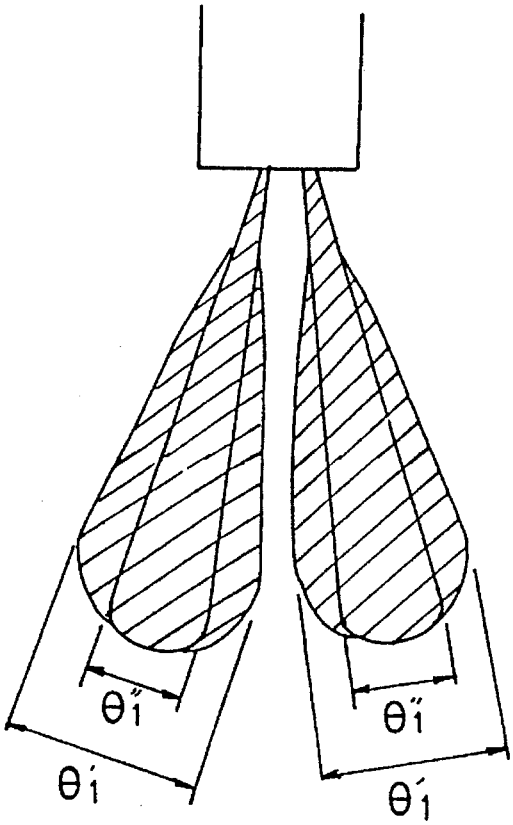
FIG. 4(A):is a front view showing a conventional fuel spray cross-sectional shape.
Figure 4B:
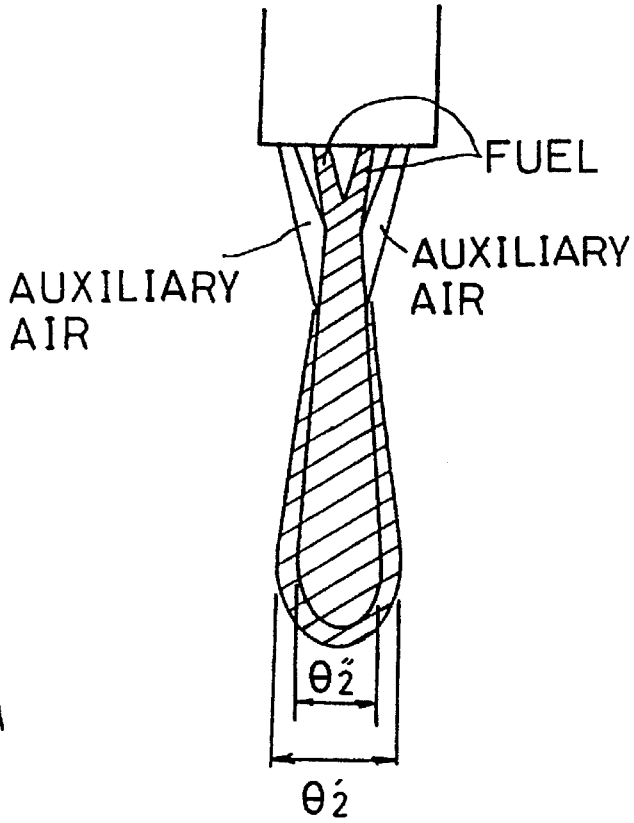
FIG. 4(B): is a side view of FIG. 4(A).
Figure 4C:
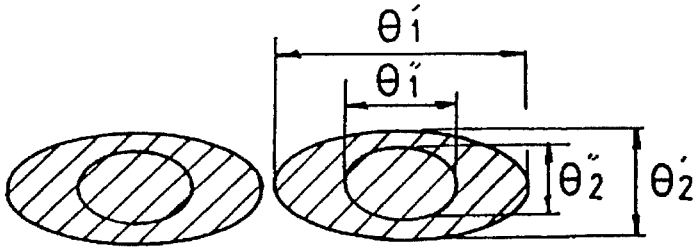
FIG. 4(C): is a bottom view of FIG. 4(A).

Two fuel sprays discharged from fuel injection holes 16*a*, and 16*b*, impact with each other in a similar manner to that shown in FIG. 4(B) which shows the fuel sprays from a conventional fuel injection valve, to thus create a single fuel spray with a cross-sectional shape flattened to a certain degree (shown as θ1", θ2" in FIGS. 4(A) through (C). Two fuel sprays discharged from fuel injection holes 16*c* and 16*d* also impact in a similar manner, to thus create a single fuel spray with a cross-sectional shape flattened to a certain degree.

Fuel spray guide passages 51*a*, 51*b* for respectively taking the fuel spray formed by the mutual impact of fuel discharged from the fuel injection holes 16*a*, 16*b*, and the fuel spray formed by the mutual impact of fuel discharged from fuel injection holes 16*c*, 16*d*, are formed in the cap 51 so as to pass through the bottom wall thereof. The fuel spray guide passages 51*a*, 51*b* are formed with angles such that the fuel sprays can be discharged towards respective bifurcated intake ports 21A, 21B as shown in FIG. 5(A).

Here the fuel spray guide passages 51 *a*, 51 *b* constitute the guide device of the present invention.

A circumferential groove 55*a* is formed in an outer peripheral wall of the cap 51 thereby creating an annular C. Auxiliary air ports 52*a*, 52*b* which communicate between the annular space C and the fuel spray guide passage 51*a* are also formed in the cap 51. The auxiliary air ports 52*a*, 52*b* are positioned with their outlets in the fuel spray guide passage 51*a* facing each other, on opposite sides of the central axis of a fuel spray formed by discharge of fuel from the fuel injection holes 16*a*, 16*b*, so that the fuel spray is impacted by auxiliary air from both sides. Auxiliary air ports 52*c*, 52*d* which communicate between the annular space C and the fuel spray guide passage 51*b* are similarly formed in the cap 51.

A sealing ring 18 is provided so as to contact with an upper edge face 55*b* of the cap 51 above the circumferential groove 55*a*, a spacer 17, and an inner peripheral wall of a holder 41, and the nozzle body 12. Furthermore, a sealing ring 19 is fitted between the outer peripheral wall of the cap 51 below the circumferential groove 55*a*, and an inner peripheral wall of the holder 41.

Figure 2:
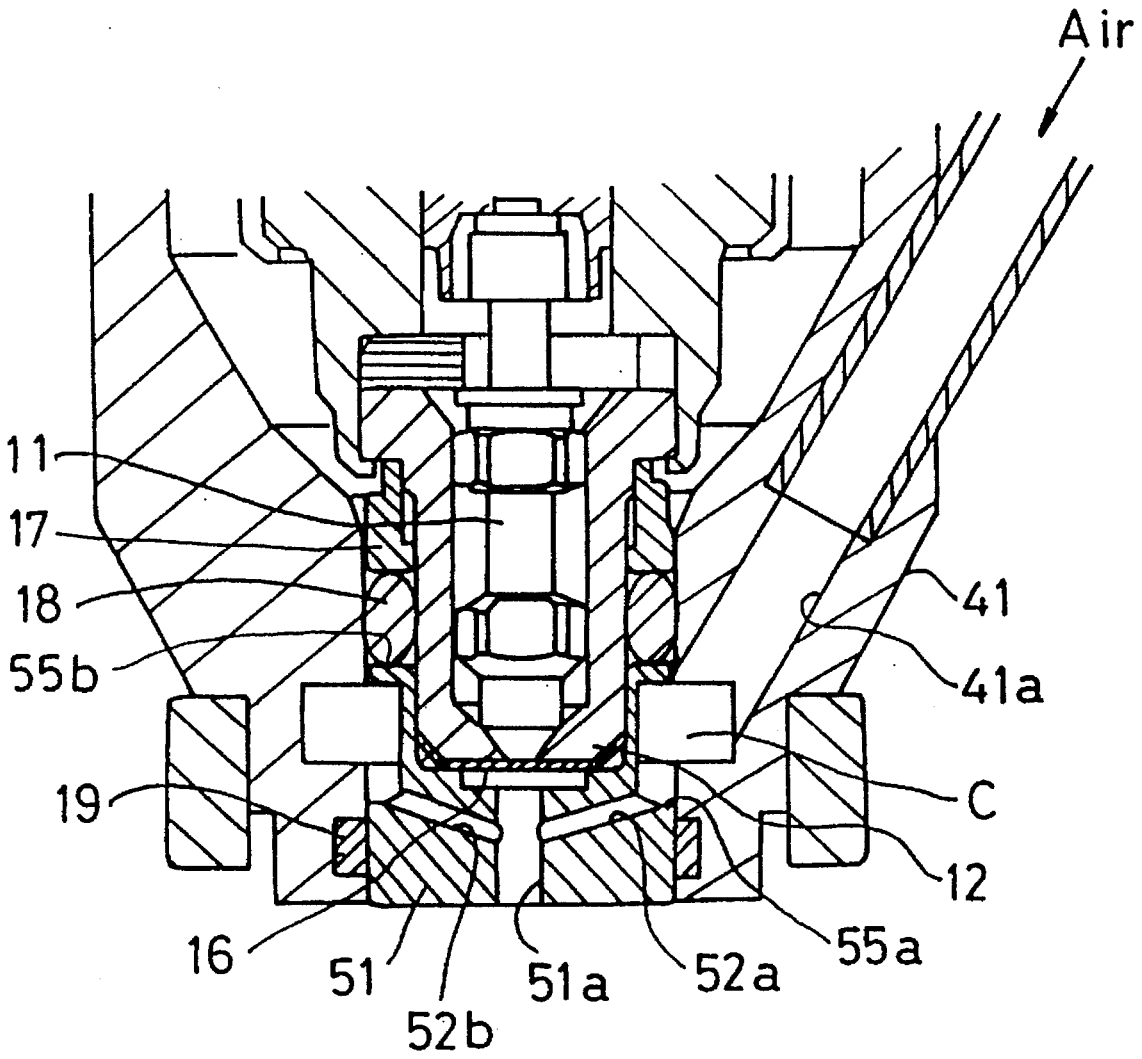
FIG. 2: is a sectional view of the fuel injection valve of the first embodiment viewed in the direction of the arrows 2—2 in FIG. 1.

Also, as shown in FIG. 2, an auxiliary air supply passage 41*a* which opens into the annular space C formed between the circumferential groove 55*a* and the holder 41 and sealed by the upper seal 18 and lower seal 19, is formed in the holder 41 for introducing air as auxiliary air, into the annular space C by way of an air hose etc. from upstream of a throttle valve (not shown in the figure).

The auxiliary air ports 52*a*, 52*b*, 52*c*, 52*d*, the annular space C, and the auxiliary air supply passage 41*a* constitute the atomization promotion device of the present invention.

As follows is a description of the operation.

Figure 5B:
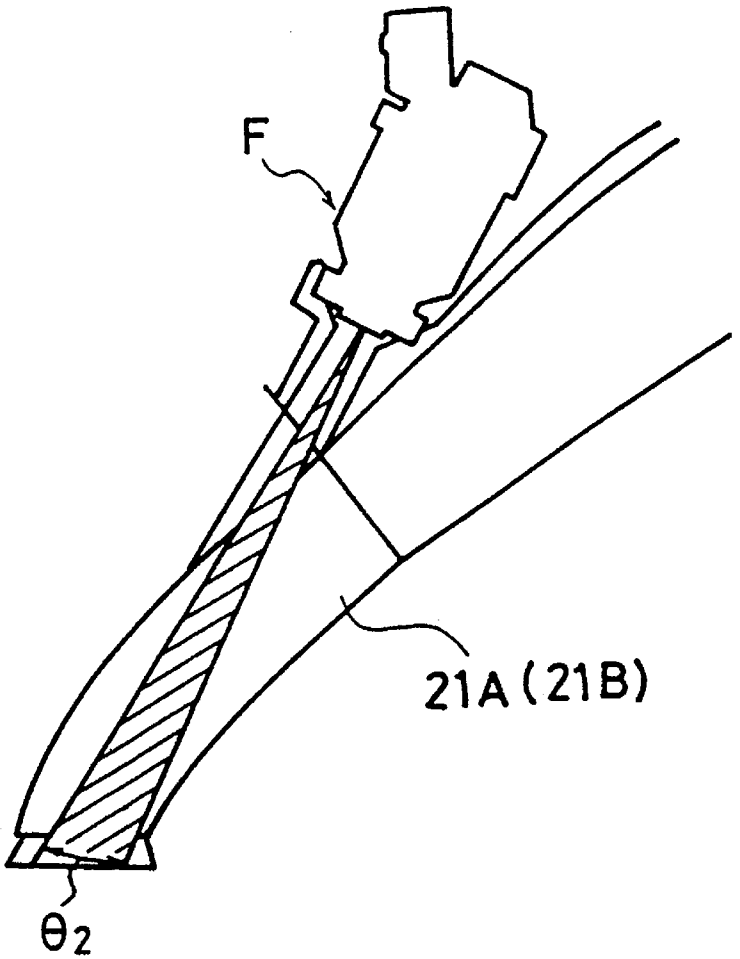
FIG. 5(B): is a side view of FIG. 5(A).
Figure 5A:
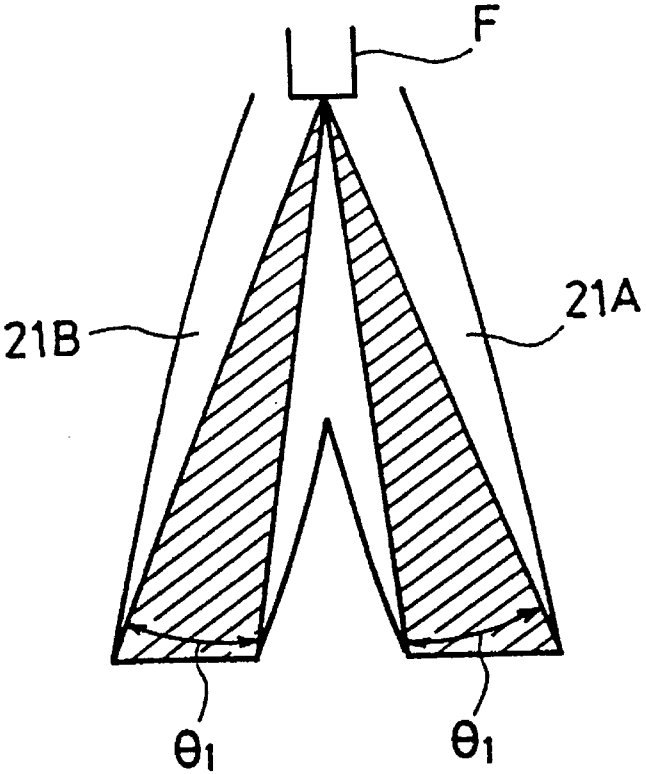
FIG. 5(A): is a front view showing an optimum fuel spray cross-sectional shape for an intake port layout.

The fuel injection valve F of the above construction is mounted as shown in FIGS 5. (A) and (B) on an outer wall of the bifurcated intake ports 21A, 21B in the vicinity of the branch point thereof, so as to spray two fuel sprays from the fuel injection holes 16*a* through 16*d* towards the respective two intake ports 21A, 21B. Since the ends of the respective intake ports 21A, 21B are curved significantly towards the vertical direction of the cylinder, the cross-sectional shape of the spray from the fuel injection valve F is necessarily flattened so that the spray angle θ1 in a direction aligned with the two intake ports is greater than the spray angle θ2 in the direction perpendicular thereto.

For this reason, as mentioned above, the two fuel sprays are discharged from the fuel injection holes 16*a* and 16*b* so as to impact with each other to thereby flatten the cross-sectional shape of the fuel spray to a certain degree. For example by an amount θ1", θ2" as shown in FIGS. 4 (A) through (C).

The fuel spray then carries on into the fuel spray guide passage 51 *a*.

Air from upstream of the throttle valve however is introduced as auxiliary air to the auxiliary air supply passage 41*a* and then passes by way of the annular space C to be discharged from the auxiliary air ports 52*a*, 52*b*. As a result atomization and subsequent vaporization of the fuel spray is promoted through impact of the auxiliary air discharged from the auxiliary air ports 52*a*, 52*b* with the fuel spray.

Subsequently, after impact with the auxiliary air, the flattened shape of the fuel spray spreads excessively downstream as shown by θ1', θ2' in FIGS. 4 (A) through (C). The spreading of the flattened shape however is controlled by impingement of the fuel spray with the inner wall of the fuel spray guide passage 51*a*.

Figure 3A:
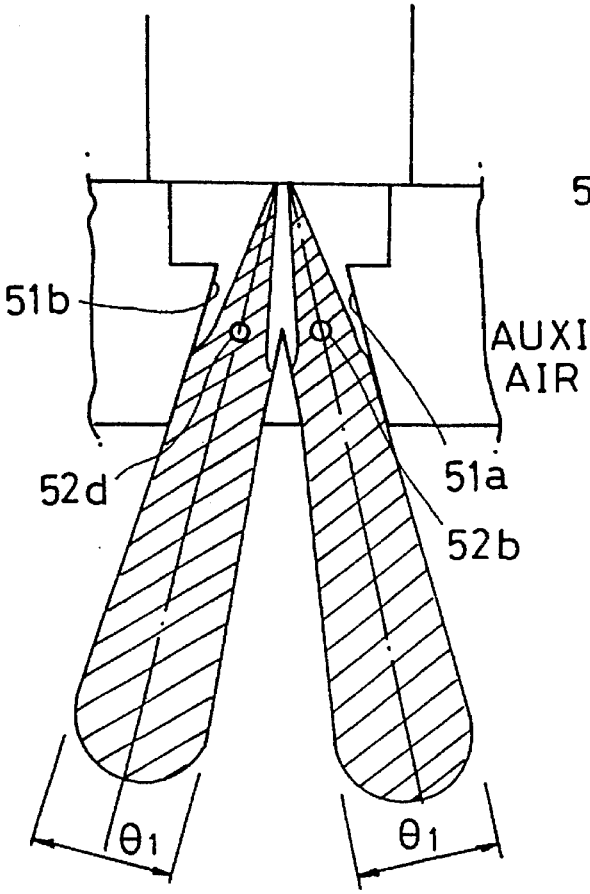
FIG. 3(A): is a front view showing a fuel spray cross-sectional shape according to the first embodiment of the present invention.
Figure 3B:
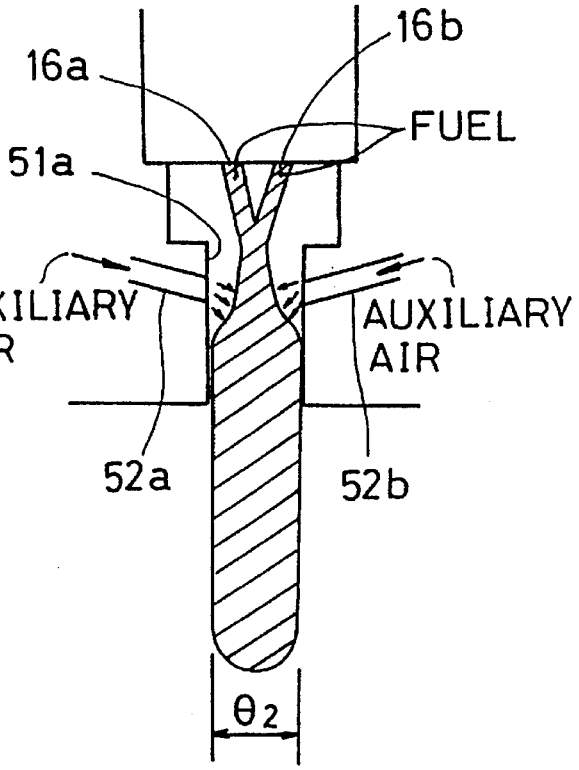
FIG. 3(B): is a side view of FIG. 3(A).
Figure 3C:
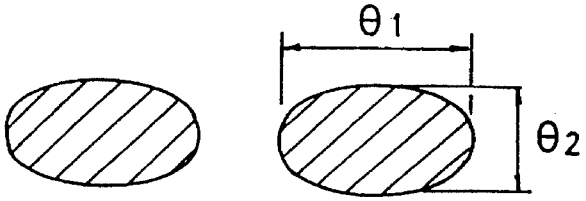
FIG. 3(C): is a bottom view of FIG. 3(A).

As a result, as shown in FIGS. 3(A), (B), the fuel spray can be formed to an optimum flattened cross-sectional shape for the intake port so as to minimize adhesion of the fuel spray to the intake port wall face.

Furthermore, with respect to the fuel sprays discharging from the respective fuel injection holes 16*c*, 16*d*, a similar result can be also be obtained by means of the auxiliary air ports 52*c*, 52*d* and the fuel spray guide passage 51 *b*.

With the first embodiment as described above, interference with atomization and subsequent vaporization of the fuel spray due to impact and attachment of the fuel spray to the wall of the intake port can be eliminated. The fuel spray can thus be sufficiently atomized and subsequently vaporized so that an improved combustion effect is realized, with a reduction in hydrocarbon emissions and an improvement in fuel consumption.

As follows is a description of a second embodiment according to the present invention.

Figure 6A:
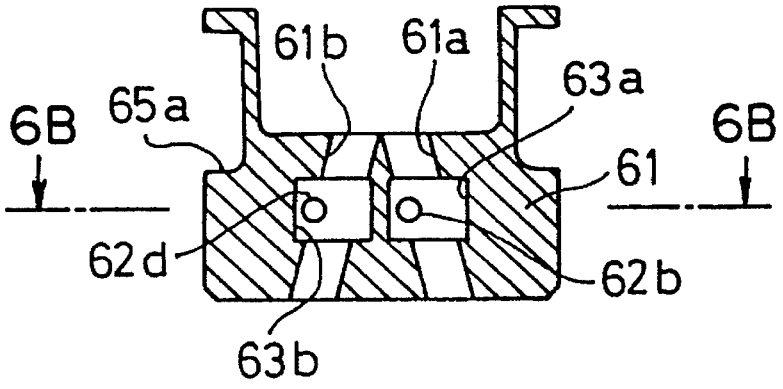
FIG. 6(A): is a longitudinal cross-sectional view of a cap portion of a fuel injection valve according to a second embodiment of the present invention.
Figure 6B:
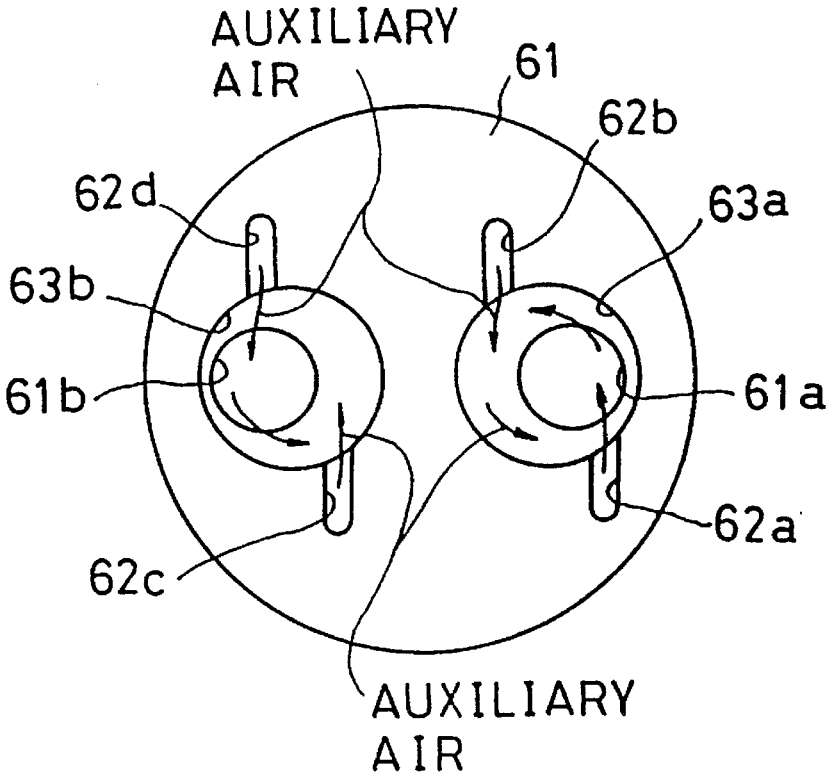
FIG. 6(B): is a sectional view in the direction of arrows 6(B)—6(B) of FIG. 6(A)

FIGS. 6(A), 6(B) show only a cap which has been modified from that of the first embodiment. Other parts of the second embodiment are the same as for the first embodiment.

The cap 61 is supportingly fitted to the outer periphery of the end portion of the nozzle body 12 which supports the needle valve 11, with the fuel injection hole plate 16 interposed therebetween. Fuel spray guide passages 61*a*, 61*b* are formed in the cap 61 so as to pass through the bottom wall thereof. The fuel spray guide passages 61*a*, 61*b* are formed with angles such that the fuel sprays can be discharged towards respective bifurcated intake ports as shown in FIG. 5(A).

As with the first embodiment, a circumferential groove 65*a* is formed in an outer peripheral wall of the cap 61. Auxiliary air ports 62*a*, 62*b* which communicate between the circumferential groove 65*a* and the fuel spray guide passage 61*a* are also formed in the cap 61. The auxiliary air ports 62*a*, 62*b* are each positioned in parallel with their outlets in the fuel spray guide passage 61*a* facing each other with an offset, and on opposite sides of the fuel spray formed by discharge of fuel from the fuel injection holes 16*a*, 16*b*. Moreover, an inner peripheral groove 63*a* is formed in an inner periphery of the opening of the fuel spray guide passage 61*a* for the air ports 62*a*, 62*b*. The inner peripheral groove 63*a* more effectively reduces the mutual impact of the auxiliary air jets resulting from the auxiliary air discharged from the auxiliary air ports 62*a*, 62*b*. Auxiliary air ports 62*c*, 62*d* which communicate between the annular space C and the fuel spray guide passage 61*b* are similarly formed in the cap 61, together with an inner peripheral groove 63*b*.

The respective air ports 62*a*, 62*b*, 62*c*, 62*d* are positioned so as to be offset with respect to the central axes of the fuel sprays. Consequently, the respective auxiliary air couplets discharged from the auxiliary air ports are directed so as not to be aligned with the same axis and hence do not collide. Wasteful reduction in energy due to impact of the auxiliary air couplets is therefore avoided, enabling the auxiliary air discharge energy to be effectively used for atomization and subsequent vaporization of the fuel spray.

In this embodiment, the auxiliary air ports are positioned respectively in parallel and on opposite sides of a central cross-section of the fuel spray which is aligned in parallel with the discharge direction of the auxiliary air. However the same effect can of course be obtained with the auxiliary air ports not in parallel, but still respectively positioned so as not to lie on the same line. Moreover, with the present embodiment, the inner peripheral grooves 63*a*, 63*b* are respectively provided on the inner periphery of the fuel spray guide passages 61*a*, 61*b* to avoid collision of the auxiliary air couplets and thus further improve the effect. However a similar effect can of course be obtained even without such inner peripheral grooves 63*a*, 63*b*.

As follows is a description of a third embodiment based on the accompanying drawings.

Figure 7A:
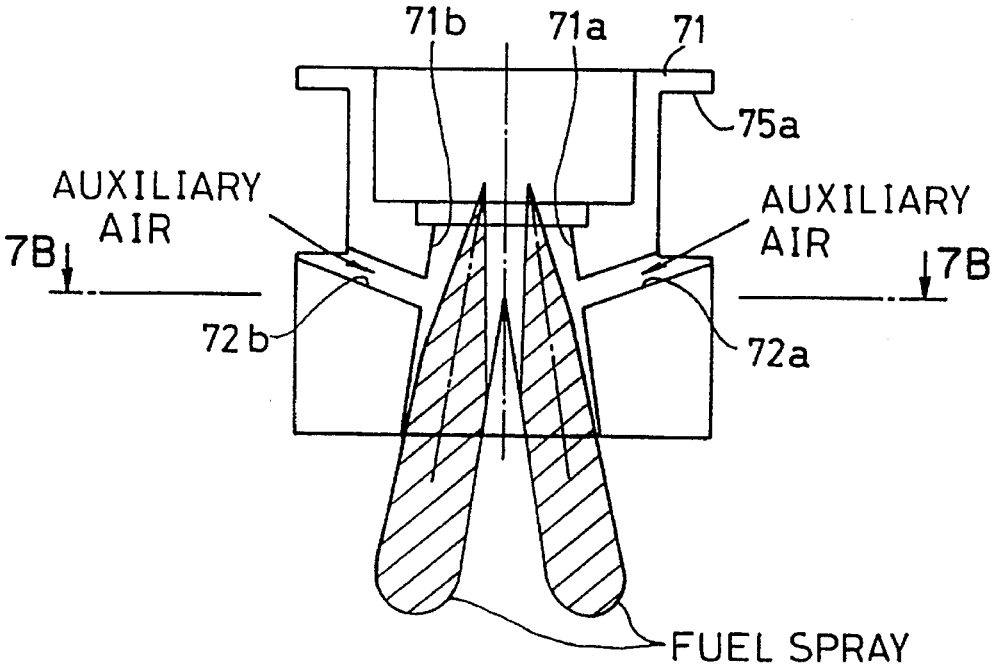
FIG. 7(A): is a longitudinal cross-sectional view of a cap portion of a fuel injection valve according to a third embodiment of the present invention.

FIG. 7(A) shows only a cap which has been modified from that of the first embodiment. Other parts of the third embodiment are the same as for the first embodiment.

Fuel spray guide passages 71*a*, 71 *b* are formed in the cap 71 so as to pass through the bottom wall thereof. The fuel spray guide passages 71 *a*, 71 *b* are formed with angles such that the fuel sprays can be discharged towards respective bifurcated intake ports as shown in FIG. 5(A). As with the first embodiment, a circumferential groove 75*a* is formed in an outer peripheral wall of the cap 71. An auxiliary air port 72*a* for communicating between the circumferential groove 75*a* and the fuel spray guide passage 71 a is also formed in the cap 71. The auxiliary air port 72*a* is positioned with its outlet in the fuel spray guide passage 71*a* so as to be able to discharge auxiliary air from the outside towards the interior of a direction of the longitudinal axis of the flattened cross-section of the fuel spray formed by discharge of fuel from the fuel injection holes 16*a*, 16*b*.

Positioning the air port 72*a* in this manner, gives the following results.

With the arrangement for example as in the first embodiment, wherein the auxiliary air impacts the fuel spray from both sides to promote atomization and subsequent vaporization of the fuel spray, the cross-sectional shape of the fuel spray is flattened more than is necessary. That is to say there is more energy than necessary to outwardly widen the cross-sectional shape of the fuel spray in the longitudinal direction thereof, resulting in situations wherein spreading cannot be sufficiently suppressed by the fuel spray guide passage alone. Consequently, such an arrangement may not be suitable for some intake port layouts.

Figure 7B:
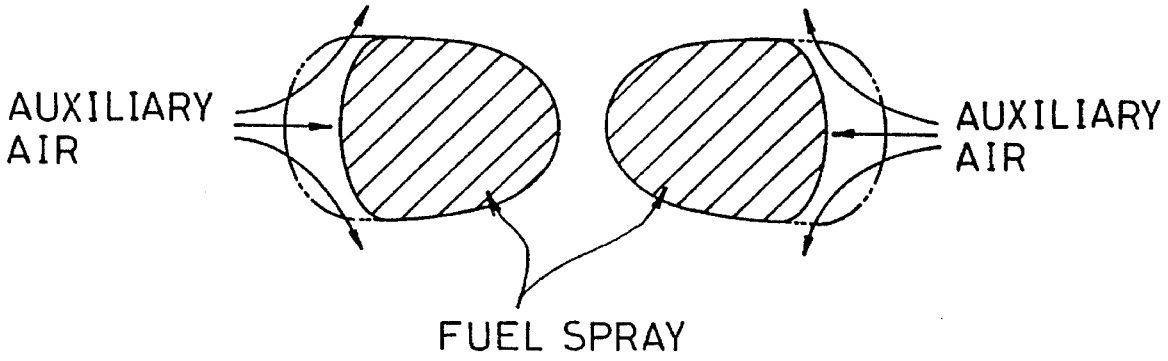
FIG. 7(B): is a sectional view of a fuel spray in the direction of the arrows 7(B)—7(B) of FIG. 7(A).

Concerning this situation, impacting the auxiliary air, in accordance with the third embodiment, from the outside towards the interior of the direction of the longitudinal axis of the cross-sectional shape of the fuel spray promotes atomization of the fuel spray. At the same time it controls excessive protruding and spreading in the longitudinal axial direction of the fuel spray cross-section which has been flattened by impact of the fuel sprays discharged from the plurality of fuel injection holes, to thereby adjust the cross-sectional shape of the fuel spray. In this way, the controlling effect on the fuel spray cross-sectional shape due to the fuel spray guide passage enables the promotion of atomization and subsequent vaporization of the fuel spray, and also positively prevents the adhesion of fuel to the inner wall of the intake port (see FIG. 7(B)).

With the third embodiment, the auxiliary air port is positioned so as to impact auxiliary air from the outside towards the interior of the direction of the longitudinal axis of the cross-sectional shape of the fuel spray. However the arrangement is not limited to this, and changing the position of the auxiliary air port so as to control the protruding and spreading of the cross-sectional shape of the fuel spray is within the limits of the present invention.

Here description of the various embodiments has been directed towards an internal combustion engine provided with two intake ports per cylinder. However the invention is not limited to this, and is also obviously applicable to an internal combustion engine provided with one intake port per cylinder. In this case, only a single fuel spray guide passage would be provided.

Furthermore, in the before-mentioned embodiments, the description has been directed to a fuel injection valve having four fuel injection holes, two fuel spray guide passages, and four auxiliary air ports. However the invention is not limited to this and may obviously comprise the same number of fuel spray guide passages as there are fuel sprays, and as many auxiliary air ports as are necessary to carry out sufficient atomization and subsequent vaporization of the fuel spray. Furthermore, the construction is not limited to providing the outlets from the auxiliary air ports in the fuel spray guide passages, and they may be provided between the downstream side of the fuel injection holes and the entrance to the fuel spray guide passage.

The transverse cross-sectional shape of the auxiliary air port and the fuel spray guide passage is not limited to a circular shape, and may be formed as an oval or similar shape as desired. In particular, with the respective embodiments, it is obvious that at least the cross-sectional shape of the outlet of the fuel spray guide passage may be suitably modified to obtain a desirable cross-sectional shape for the fuel spray. However in the case where auxiliary air is not supplied after warm up, the locations and dimensions are preferably set so that the main flow of the fuel spray does not impact with the fuel spray guide passage with no auxiliary air supply.

With the respective embodiments, the construction is such that the air discharged from the auxiliary air ports is discharged towards the downstream side in the fuel spray discharge direction. In this way impact of the auxiliary air with the fuel spray from opposite directions can be avoided, thereby preventing excessive spreading of the fuel spray cross-section. Furthermore, the desirable penetrating force of the fuel spray is not reduced by a cancellation effect of auxiliary air forces, and subsequent reverse flow of the fuel spray can therefore be prevented.

When the fuel spray guide passage is branched into a plurality of passages to correspond to an intake port having two or more legs, the downstream opening of the auxiliary air port may be provided in the fuel spray guide passage downstream of the branch point to thereby eliminate any interference with auxiliary air discharged into another of the fuel spray guide passages.

With the respective embodiments, when the engine intake air is used for introduction of the auxiliary air, since the discharge energy of the auxiliary air will vary due to the various operating conditions, the flat cross-sectional shape of the fuel spray will also change accordingly. It is thus difficult to always obtain an optimum flattened cross-sectional shape. More specifically, when the discharge velocity of the auxiliary air is low, the discharge energy in the auxiliary air will be small so that the impact energy between the auxiliary air and the fuel spray is also less. This results in a certain reduction in the diffusion energy of the fuel spray as it passes through the fuel spray guide passage. The fuel spray therefore follows along the inner peripheral wall of the fuel spray guide passage and is discharged therefrom, and the controlling effect of the guide passage in the cross sectional direction is also maintained downstream. Accordingly, a sufficient controlling effect due to the fuel spray guide passage can be realized, thus ensuring that the required flattened cross-sectional shape of the fuel spray can be obtained.

In contrast to this, when the discharge velocity of the auxiliary air is high, the discharge energy in the auxiliary air will be great so that the impact energy between the auxiliary air and the fuel spray is also great. As a result, the diffusion energy of the fuel spray while passing through the fuel spray guide passage cannot be reduced. That is to say, even after the fuel spray has passed out of the fuel spray guide passage, the energy causing spreading in the flattened cross-section still remains so that a sufficient controlling effect due to the fuel spray guide passage cannot be realized, making it impossible to obtain the required flattened cross-sectional shape of the fuel spray.

To overcome the above problem, a large number of experiments were repeatedly carried out, with it being necessary to adjust the positioning and shape of the air ports and the fuel spray guide passage in order to obtain an optimum flattened cross-sectional shape for the fuel spray irrespective of variations in the auxiliary air discharge velocity. If the dimensions of the fuel spray guide passage are determined however based on the following equation obtained by the present inventors, an optimum flattened cross-sectional shape for the fuel spray can be easily obtained irrespective of variations in the auxiliary air discharge velocity.

Figure 8A:
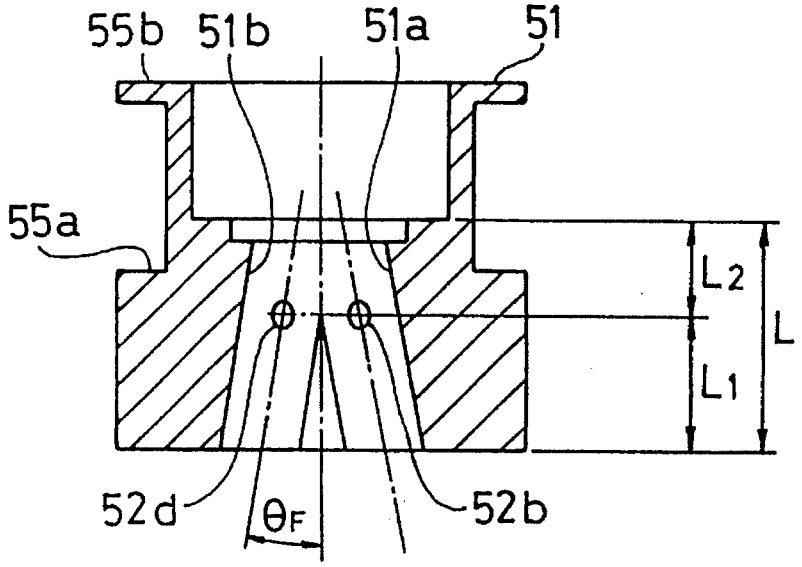
FIGS. 8(A) and (B): are diagrams illustrating the symbols used in the equations.
Figure 8B:
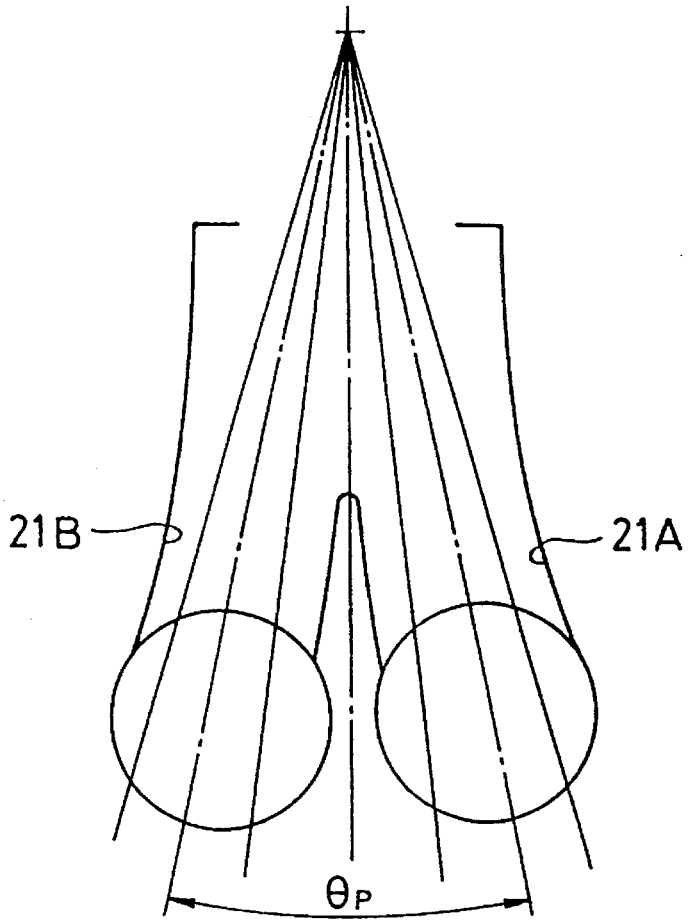

That is to say, as shown in FIGS. 8(A), 8(B), with L1 as the distance from the lower face of the fuel spray guide passage to the central point of the downstream opening of the auxiliary air passage, L2 as the distance from the central point of the downstream opening of the auxiliary air passage to the lower face of the fuel injection orifice, L (=L1+L2) as the distance from the lower face of the fuel spray guide passage to the lower face of the fuel injection orifice, θF (θP/2) as ½ the angle between the respective central axes of the two fuel spray guide passages, and θP as the angle between the respective central axes of the bifurcated intake ports; then by setting said L1 to L1' which is obtained so as to satisfy the following equation, then even with a change in the flow velocity of the auxiliary air, a stabilized fuel spray shape which changes only slightly can be obtained.

$$L1'=L1\times\tan((\theta P/2+X)\times\tan(90-\theta P/2)$$

where:

X is within the range from 2.5 ~3.5, and L1 is the maximum length without supply of auxiliary air, at which the inner periphery of the fuel spray guide passage does not interfere with the fuel spray.

Here the above equation has been described in application to bifurcated intake ports. However it is of course also applicable to intake ports divided into more than two legs.

INDUSTRIAL APPLICABILITY

With the fuel injection valve of the present invention as described above, the atomization and subsequent vaporization of the fuel is promoted while enabling the creation of an optimum fuel spray cross-sectional shape for various internal combustion engine intake port layouts. Hence due to the improvement in combustion the valve has many possible industrial uses.

We claim:

1. A fuel injection valve comprising a fuel injection valve body having at least one fuel injection hole to diffusingly discharge fuel therefrom in a fuel spray towards at least one intake port of an internal combustion engine, atomization promotion means for discharging air towards the fuel spray discharged from the fuel injection valve body and thereby promoting atomization of said fuel spray, and guide means having an opening portion surrounding an outer peripheral portion of the fuel spray which has been subjected to atomization promotion, for controlling the cross-sectional shape and spray direction of the fuel spray wherein said guide means is branched into two opening portions, with an atomization promotion means provided in each of the opening portions, and with L1 as a distance from a lower face of said guide means to a central point of an air discharge portion of said atomization promotion means, θF (θP/2) as ½ an angle between respective central axes of the two opening portions of said guide means, and θP as an angle between respective central axes of the bifurcated intake ports of the internal combustion engine, then said L1 is set to L1' which satisfies the following equation;

$$L1'=L1\times\tan(\theta P/2+X)\times\tan(90-\theta P/2)$$

where:

X is within the range from 2.5~3.5, and L1 is the maximum length without air discharge from the atomization promotion means, at which an inner peripheral wall of the opening portion of the guide means does not interfere with the fuel spray.

2. A fuel injection valve as claimed in claim 1, wherein said at least one fuel injection hole comprises a plurality of fuel injection holes facing in directions which intersect each other, said plurality of fuel injection holes being arranged so that the fuel sprays discharged therefrom impact with each other to flatten the cross-sectional shape of the resultant fuel spray.

3. A fuel injection valve as claimed in claim 2, wherein said atomization promotion means is constructed so as to discharge air in a direction to control the flattening of the flattened fuel spray, to thereby adjust the cross-sectional shape of the fuel spray.

4. A fuel injection valve as claimed in claim 1, wherein said atomization promotion means is constructed so as to discharge air from opposite sides of the fuel spray and thus flatten the cross-sectional shape of the fuel spray.

5. A fuel injection valve as claimed in claim 1, wherein said atomization promotion means is constructed with air discharge ports for discharging air provided opposite to and offset from each other with the fuel spray interposed therebetween.

6. A fuel injection valve as claimed in claim 1, wherein said atomization promotion means is constructed so as to discharge air towards the downstream side in the direction of progress of the fuel spray.

7. A fuel injection valve as claimed in claim 1, wherein said atomization promotion means is provided at a point downstream of the branch point of the two opening portions of said guide means.

* * * * *